US007489288B2

(12) United States Patent
Naganuma et al.

(10) Patent No.: US 7,489,288 B2
(45) Date of Patent: Feb. 10, 2009

(54) DRIVE CONTROL APPARATUS FOR DISPLAY PANEL

(75) Inventors: Hideo Naganuma, Fukuroi (JP); Hisashi Kubota, Fukuroi (JP)

(73) Assignee: Pioneer Corporation, Tokyo-to (JP)

( * ) Notice: Subject to any disclaimer, the term of this patent is extended or adjusted under 35 U.S.C. 154(b) by 771 days.

(21) Appl. No.: 11/069,046

(22) Filed: Mar. 2, 2005

(65) Prior Publication Data

US 2005/0231445 A1 Oct. 20, 2005

(30) Foreign Application Priority Data

Mar. 2, 2004 (JP) ..... P2004-057615

(51) Int. Cl.
*G09G 3/10* (2006.01)
*G09G 3/28* (2006.01)

(52) U.S. Cl. ..... 345/60; 315/169.4

(58) Field of Classification Search ..... 345/617, 345/55–100, 204–214, 690–697; 348/173; 315/169.4

See application file for complete search history.

(56) References Cited

U.S. PATENT DOCUMENTS 5,912,651 A * 6/1999 Bitzakidis et al. ..... 345/58
6,806,852 B2 10/2004 Ishizuka et al.
7,271,828 B2 * 9/2007 Okano ..... 348/173

* cited by examiner

*Primary Examiner*—David L Lewis
(74) *Attorney, Agent, or Firm*—Sughrue Mion, PLLC

(57) ABSTRACT

A drive control apparatus for a display panel formed by arranging a plurality of pixels having a plurality of cells emitting lights of different colors comprising: an obtaining device which obtains an image signal effecting a display on the display panel, and a drive device for generating a drive signal for driving the display panel based on the obtained image signal, wherein the drive device generates the drive signal performing a reverse of a light emission mode which includes at least one of a reverse between a light emission state and a light stopping state for each of the cells and a reverse of gradation in the light emission state of each of the cells with respect to each of the pixels at a predetermined time.

12 Claims, 6 Drawing Sheets

DRIVE CONTROL APPARATUS FOR DISPLAY PANEL

BACKGROUND OF THE INVENTION

1. Field of the Invention

The present invention relates to a technical field of controlling drive for a display device such as a plasma display panel.

2. Related Art

In recent years, a thinner display apparatus is preferred in accordance with glow in size of the display devices. Especially, in addition to a cathode-ray tube (CRT) and a liquid crystal display (LCD), a plasma display panel (PDP) having a self-luminous feature is put into practical use lately.

In a conventional technique, a display apparatus of the self-luminous type (hereinafter referred to as a self-luminous typed is play apparatus) provides a brightness reduction process to an image data to be displayed frame by frame, and the display panel is driven based on the image data processed to reduce the brightness as disclosed in, for example, U.S. Pat. No. 6,806,852, which is hereby incorporated by reference.

However, in such a self-luminous type display apparatus, when only a specific image is displayed in various sites such as a public facility, even though the brightness of each of pixels is reduced as in the above, constantly light-emitting pixels are extremely deteriorated. Further, in the self-luminous type display apparatuses, because a specific pixel is displayed for a specific time length, a persistence of vision is derived to thereby cause baking of the display panel. Thus an image data cannot be clearly displayed.

SUMMARY OF THE INVENTION

The present invention is provided in consideration of the above. An object of the present invention is to provide a drive control apparatus of the display panel which can prevent deterioration of each of light-emitting pixels and display panel baking caused when a specific image data is displayed for a long time.

In order to solve the aforementioned problems according to the first aspect of the present invention, there is provided a drive control apparatus for a display panel formed by arranging a plurality of pixels having a plurality of cells emitting lights of different colors comprising: an obtaining device which obtains an image signal effecting a display on the display panel, and a drive device which generates a drive signal for driving the display panel based on the obtained image signal, wherein the drive device generates the drive signal performing a reverse of a light emission mode which includes at least one of a reverse between a light emission state and a light stopping state for each of the cells and a reverse of gradation in the light emission state of each of the cells with respect to each of the pixels at a predetermined time.

According to the second aspect of the present invention, there is provided the drive control apparatus for a display panel according to the first aspect, wherein the drive device generates the drive signal performing a reverse of a light emission mode which includes at least one of a reverse between a light emission state and a light stopping state for each of the cells of the pixels and a reverse of gradation in the light emission state of each of the cells with respect to each of the colors.

According to the third aspect of the present invention, there is provided the drive control apparatus for a display panel according to the second aspect, wherein when each of the pixels is made up of cells respectively emitting lights of three primary colors of red (R), green (G), and blue (B), the drive device generates the drive signal performing a reverse of a light emission mode with respect to each of the three primary colors.

According to the fourth aspect of the present invention, there is provided the drive control apparatus for a display panel according to the first aspect, wherein when the drive device extracts a color difference signal from the obtained image signal and generates the drive signal from the extracted color difference signal, the drive device generates the drive signal performing a reverse of a light emission mode which includes at least one of a reverse between a light emission state and a light stopping state for each of the cells of the pixels and a reverse of gradation in the light emission state of each of the cells with respect to each of the color difference signals.

According to the fifth aspect of the present invention, there is provided the drive control apparatus for a display panel according to the first to fourth aspects, further comprising: a detection device which detects at least one of a cumulative light emitting number and a cumulative light emitting time for each of the pixels, and a control device which makes the drive device generate the drive signal for reversing a lighting mode for each of the pixels at a time when the number of the cumulative light emitting number or the cumulative light emitting time reach a predetermined number or a predetermined time.

According to the sixth aspect of the present invention, there is provided the drive control apparatus for a display panel according to the first to fourth aspects, further comprising: an operation device used at a time of instructing the reverse of a light emission mode of each of the cells, wherein the drive device generates the drive signal for performing the reverse of the lighting mode for each of the pixels at the time when the operation device instructs the reverse.

DESCRIPTION OF THE PREFERRED EMBODIMENTS

Figure 1:
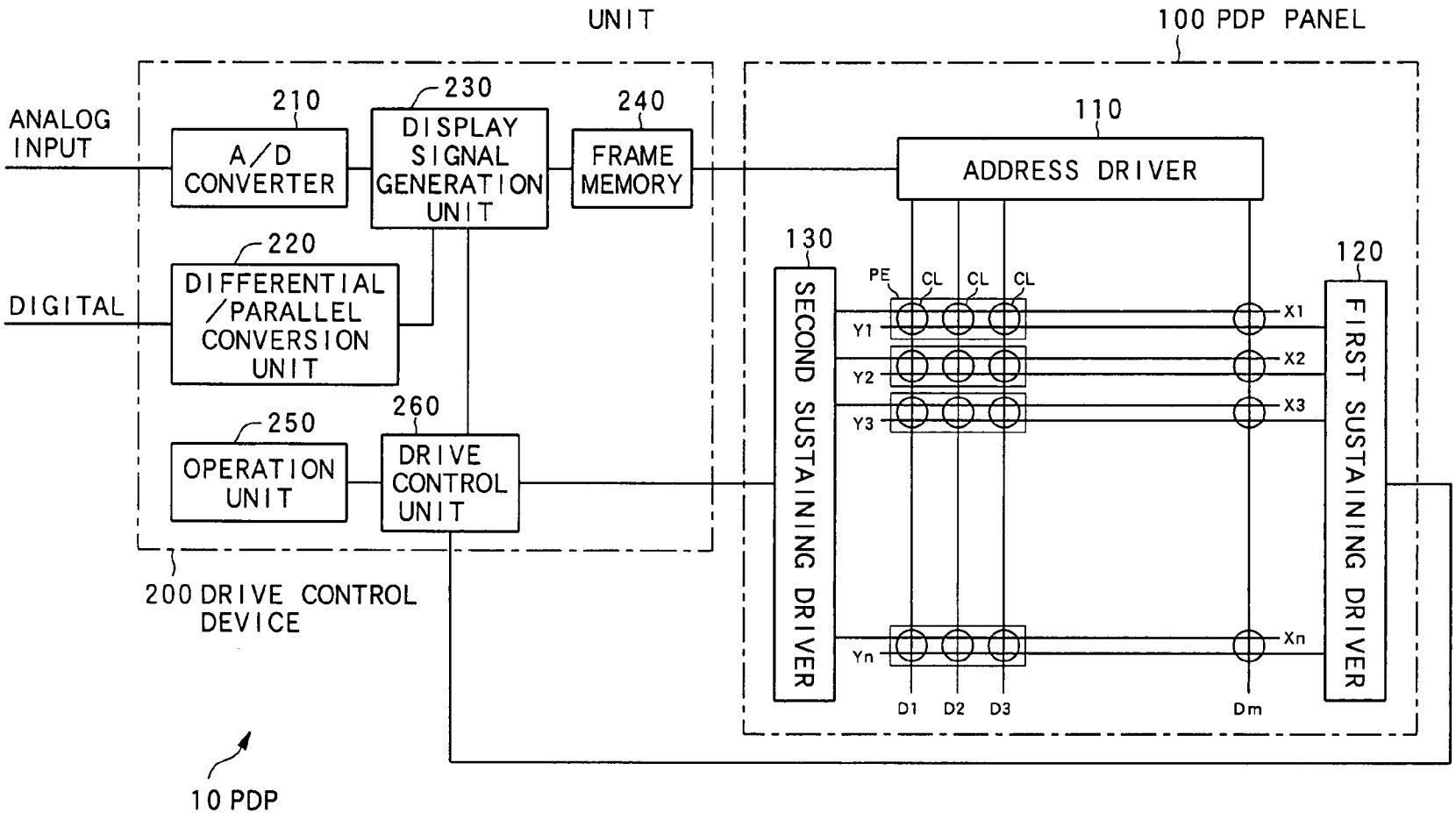
FIG. 1 is a block diagram for showing a system configuration of a PDP according to an embodiment of the present invention.

Preferred embodiments of the present invention will be described in conjunction with figures. Hereinafter, each meaning of the reference numbers in the drawings is as follows: 1:PDP, 100:PDP panel, 200:drive control apparatus, 201:AD converter, 220:differential/parallel conversion unit, 230:display signal generation unit, 240:frame memory, 250 operation unit, and 260:drive control unit.

The below-described embodiments are about a drive control unit and an application of the drive control unit for a display panel according to the present invention.

First, in reference of FIG. 1, an explanation will be given for a structure of the PDP. FIG. 1 is a block diagram for showing the structure of the PDP according to the present invention.

As shown in FIG. 1, the PDP 10 according to the present invention includes a display panel (hereinafter referred to as PDP panel 100), and a drive control unit 200 for generating a display signal to drive the PDP panel 100. The PDP 10 provides a predetermined treatment to the inputted image data, and the inputted image signal is displayed on the PDP panel 100.

The display panel 100 includes column electrodes D1 to Dm juxtaposed in a vertical direction with respect to the PDP panel 100, and row electrodes X1 to Xn and row electrodes Y1 to Yn, respectively juxtaposed in a horizontal direction with respect to the PDP panel 100, an address driver 110 for applying a voltage pulse to the column electrodes D1 to Dm, and a pair of sustain drivers 120 and 130 for applying a voltage pulse to the row electrodes X1 to Xn and the row electrodes Y1 to Yn (hereinafter referred to as a first sustain driver and a second sustain driver).

The address driver 110 is connected to the column electrodes D1 to Dm juxtaposed in a vertical direction with respect to the PDP panel 100. The display signal outputted from the drive control unit 200 is inputted in the address driver 110

The address driver 110 is to generate a data pulse of a voltage pulse corresponding to the inputted display signal, which is to be applied to the column electrodes D1 to Dm.

The second sustain driver 120 is connected to the row electrodes X1 to Xn juxtaposed in a horizontal direction with respect to the PDP panel 100. A drive signal outputted from the drive control apparatus 200 is inputted into the first sustain driver 120.

Further, the first sustain driver 120 generates a sustain pulse corresponding to the inputted display signal and applies the generated sustain pulse of the generated voltage pulse to the row electrodes X1 to Xn.

The second sustain driver 130 is juxtaposed in a horizontal direction with respect to the PDP panel 100 and connected to the row electrodes Y1 to Yn juxtaposed in parallel to row electrodes X1 to Xn. The drive signal outputted from the drive control apparatus 200 is inputted into the second sustain driver 130.

The second sustain driver 130 generates the sustain pulse corresponding to the inputted drive signal and applies the generated sustain pulse to row electrodes Y1 to Yn.

On the other hand, the drive control apparatus 200 includes an analog/digital converter (A/D converter) for converting an image signal formed from an inputted analog signal (hereinafter referred to as an analog image signal) to a digital signal, a differential/parallel conversion unit 220 for converting an inputted differential signal for a parallel process, a display signal generation unit 230 for generating a display signal for driving each of the drivers 110, 120, and 130 of the PDP panel 100 and generating the a display signal of reversing display of each pixel PE of the PDP panel 100 at a predetermined time, a frame memory 240, an operation unit 250, and a drive control unit 260 for detecting a cumulative light emitting number and or a cumulative light emitting time at a time of driving the PDP panel 100 and controlling generation of the display signal of reversing the display of each pixel PE of the PDP panel 100 at the predetermined time.

For example, the A/D converter 210 and the differential/parallel conversion unit 220 forms an obtaining device according to the present invention. The display signal generation unit 230 forms a driving device according to the present invention. For example, the drive control apparatus 260 in the embodiment forms a detecting device and a control device according to the present invention. The control unit 250 forms an operation device according to the present invention.

An image signal formed from an analog signal is inputted from an outside to the A/D converter 210. The A/D converter 210 converts the inputted analog image signal to an image signal formed from a digital signal (hereinafter referred to as a digital image signal) and outputs the converted image signal to the display signal generation unit 230.

For example, the A/D converter 210 generates the digital image signal by digitalizing the inputted analog signal to be 8 bit.

Into the differential/parallel conversion unit 220, differential signals such as a format and a high definition multimedia interface (HDMI) format are inputted. The differential/parallel conversion unit 220 converts the inputted differential signals for a parallel process and outputs the converted digital image signal generation unit 230 under a control of the drive control unit 260.

For example, by converting the inputted differential signal for the parallel process, an image signal of 28 bit can be generated.

In the display signal generation unit 230, the digital image signal outputted from the A/D converter 210 or the digital image signal outputted from the A/D converter 210 is inputted. The display signal generation unit 230 performs a predetermined digital signal process and various drive processes such as an error diffusion process, a tone wedge process, and a gamma conversion process with respect to the inputted digital signal under the control of the drive control unit 260, and also does a reversal process for a brightness signal and a color difference signal, a reversal process respectively for red, green, and blue signals (RGB signals), and a subfield conversion process, to thereby generate the display signal and output the generated display signal to the frame memory 240

Incidentally, a structure and a detail of the display signal generation unit 230 according to the embodiment will be described later.

The display signal outputted from the display signal generation unit 230 is inputted into the frame memory 240. The frame memory 240 serves the inputted image data, i.e. data that has been subjected to a predetermined image process, to the PDP panel 100 under the control of the drive control unit 260. Specifically, the frame memory 240 temporarily stores the display signal inputted from the display signal generation unit 230 based on a synchronized signal outputted from the drive control unit 260 and outputs the stored display signal to each of the drivers.

The control unit 250 is made up of a remote control device or an input device such as a keyboard, whichever including a large number of keys such as various confirmation buttons, selection buttons, and numeric keys. Especially, in this embodiment, the below described reversal process for the brightness signal and the color difference signal and the below-described reversal process for each of the RGB signals with respect to each cell CL of the pixels PE.

The drive control unit 260 controls parts of the apparatus based on an instruction of an operator through the input unit 250 (not shown) and detects the cumulative light emitting number and the cumulative light emitting time in each cell CL of the pixels PE.

Further, the drive control unit 260 performs the reversal process for the brightness signal and the color difference signal and the reversal process for each of the RGB signals within the image signals inputted by controlling the display signal generation unit 230 when an operator instructs to perform the reversal process of each of the pixels PE through the control unit 250 or it is detected that the number of emitting lights reaches a predetermined times or a predetermined time lapses.

For example, a timer for counting the number of emitting light or a timer for detecting a time of emitting light is equipped inside the drive control unit 260. The drive control unit 260 detects the cumulative light emitting number and the cumulative light emitting time by the counter or the timer. 0031 Meanwhile, the number or the time between the start of emitting light to each of the reversal process is set in the operation unit 250 (not shown) at a time of manufacturing the operation unit and the set values are stored inside the drive control unit in advance.

Meanwhile, the drive control unit 260 selects one of the reversal process for the brightness signal, the reversal process for the color difference signals, and the reversal process for each of the RGB signals with respect to the pixels PE for reverse processing each pixel PE.

Next, a structure and an operation of the display signal generation unit according to the present invention will be described in reference of FIGS. 2 to 6.

Figure 2:
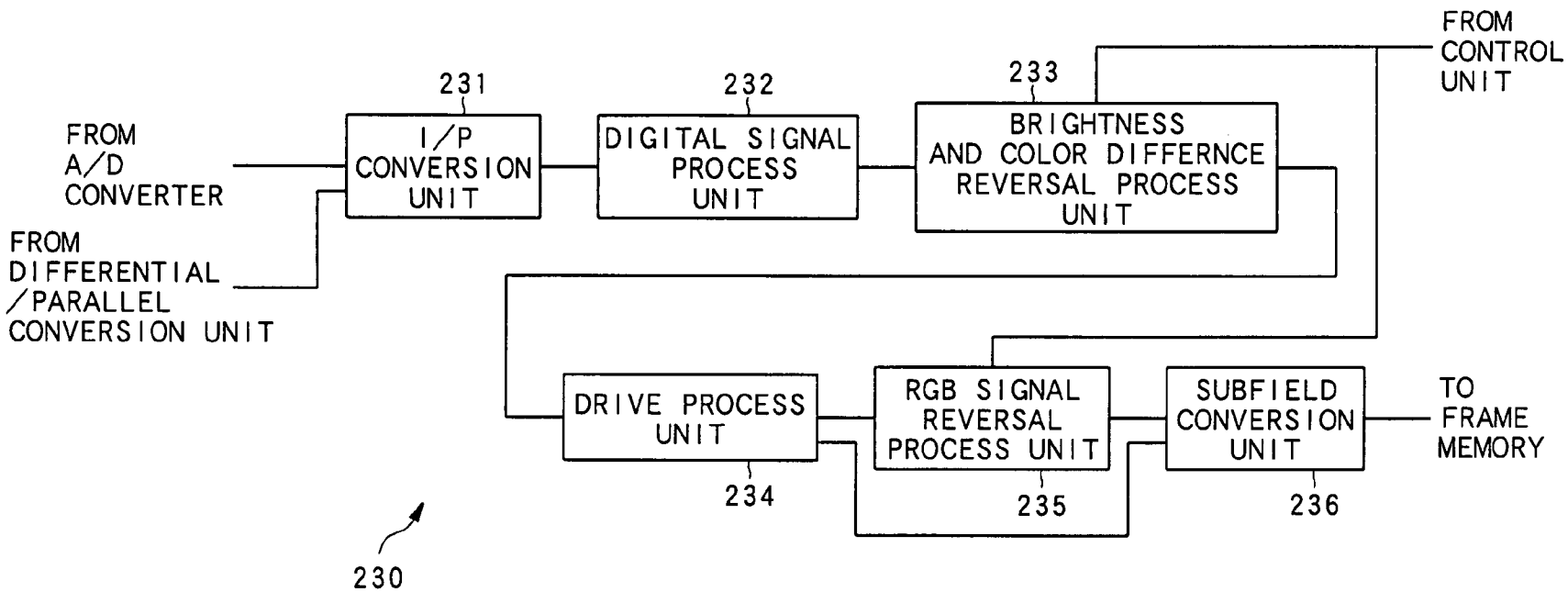
FIG. 2 is a block diagram for showing a structure of a display signal generation unit of a PDP according to an embodiment of the present invention.

FIG. 2 is a block diagram for showing a structure of the display signal generation unit according to the present invention. FIGS. 3 and 4 show an example of a PDP panel for displaying an image signal obtained by reverse processing an inputted image signal to explain the reversal process of the brightness and color difference reversal process unit according to the embodiment of the present invention. Figures and 6 show an example of a PDP panel for displaying an image signal obtained by reverse processing an inputted image signal to explain the reversal process of the RGB signal reversal process unit according to the embodiment of the present invention.

The display signal generation unit 230 is made up of an interlace/progressive conversion unit 231 (hereinafter referred to as an I/P conversion unit), a digital signal process unit 232 for processing a digital signal to obtain a high definition, a brightness and color difference reversal process unit 233 for reverse processing the brightness signal and each of the color difference signals, a drive process unit 234 for generating various signals related to RGB and conducting a gamma correction and other drive processes, a RGB signal reversal process unit 235 for reverse processing various signals related to RGB, and a subfield conversion unit 236 for conducting a subfield process, as shown in FIG. 2.

An digital image signal is inputted into the I/P conversion unit 231. The I/P conversion unit 231 converts a digital image signal of interlace scan to a digital signal of progressive scan at every input of the digital image signal, and outputs thus converted digital signal to the digital signal process unit 232.

The digital image signal converted to the digital signal is inputted into the digital signal process unit 232. The digital signal process unit 232 conducts separation into the brightness signal and the color signal and the other signal processes for a high definition with respect to the inputted image signal under a control of the drive control unit 260.

A digital image signal subjected to a predetermined signal process is inputted in the brightness and color difference reversal process unit 233. The brightness and color difference reversal process unit 233 provides the reverse process with respect to the brightness signal or each of the color difference signals and outputs thus reverse processed brightness signal or color difference signals to the drive process unit 234.

Specifically, the brightness and color difference reversal process unit 233 according to the embodiment of the present invention generates an image data for reversing the brightness in each cell CL of each pixel PE displayed by the brightness signal on the basis of the inputted image signal when it is instructed to reverse the brightness signal by the drive control unit 260.

Figure 3A:
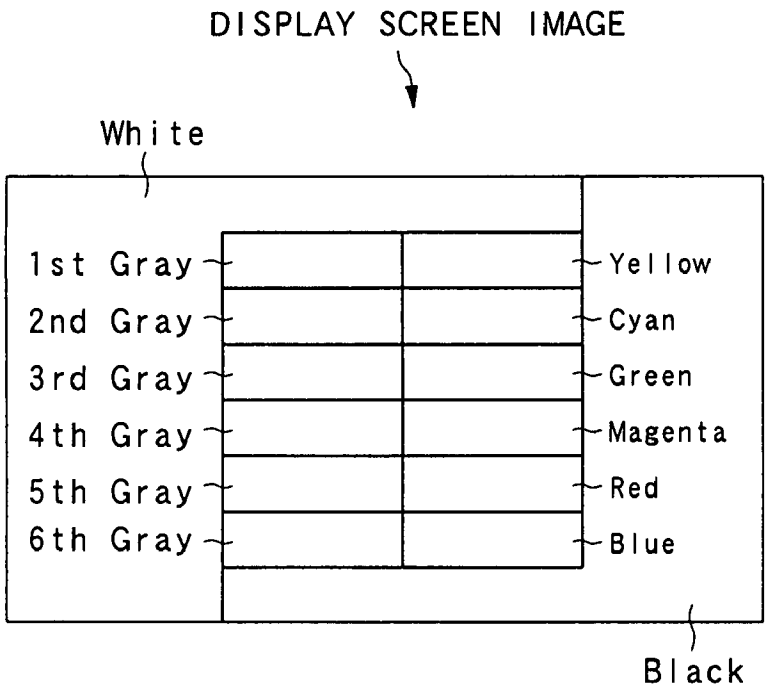
FIG. 3A shows an example of a PDP panel for displaying an image signal that is processed to be reversed against an inputted image signal to explain the reversal process in a brightness and color difference reversal process unit according to an embodiment of the present invention.

For example, when it is instructed to reverse the brightness signal with respect to the inputted digital image signal by the drive control unit 260 such that an image signal for displaying an image of a color bar (hereinafter referred to as a color bar signal) including white, black, and various colors shown in FIG. 3A is inputted, the brightness and color difference reversal process unit 233 reverse-processes the brightness signal to generate an image signal for displaying an image shown in FIG. 3B.

Figure 3B:
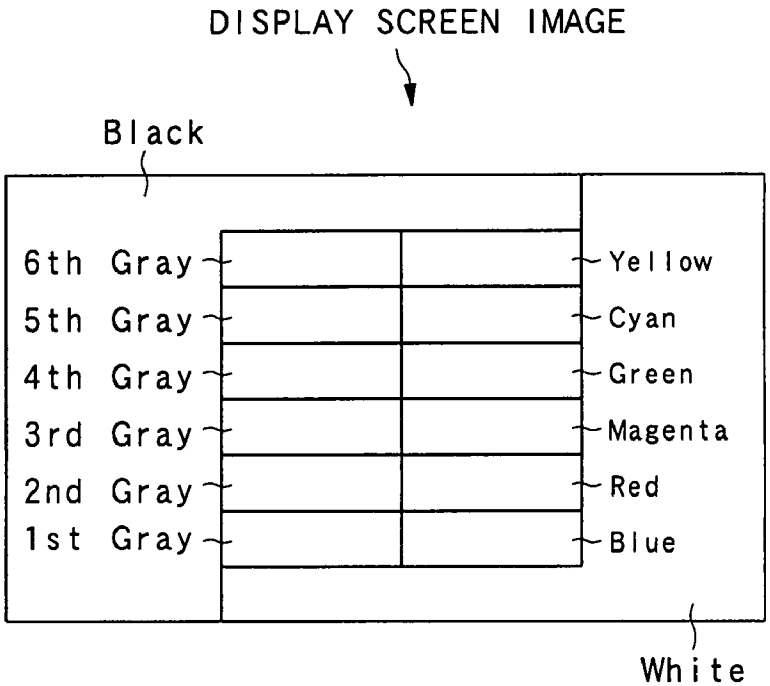
FIG. 3B shows an example of a PDP panel for displaying an image signal that is processed to be reversed against an inputted image signal to explain the reversal process in a brightness and color difference reversal process unit according to an embodiment of the present invention.

In FIG. 3B, a 1st gray to a 6th gray are gray colors gradually darkened in the order from the 1st gray to the 6th gray.

Further, the brightness and color difference reversal process unit 233 according to the embodiment of the present invention generates an image signal for reversing the color differences in each cell CL of each pixel PE displayed by the color difference signals based on the inputted image signal when the drive control unit 260 instructs the reverse of the various color difference signals.

Specifically, according to this embodiment, the brightness and color difference reversal process unit 233 reverses each of the RGB signals while maintaining the brightness of each color signal, that is to reverse neutral tones, when it is instructed to reverse the color difference signals by the drive control unit 260.

Figure 4B:
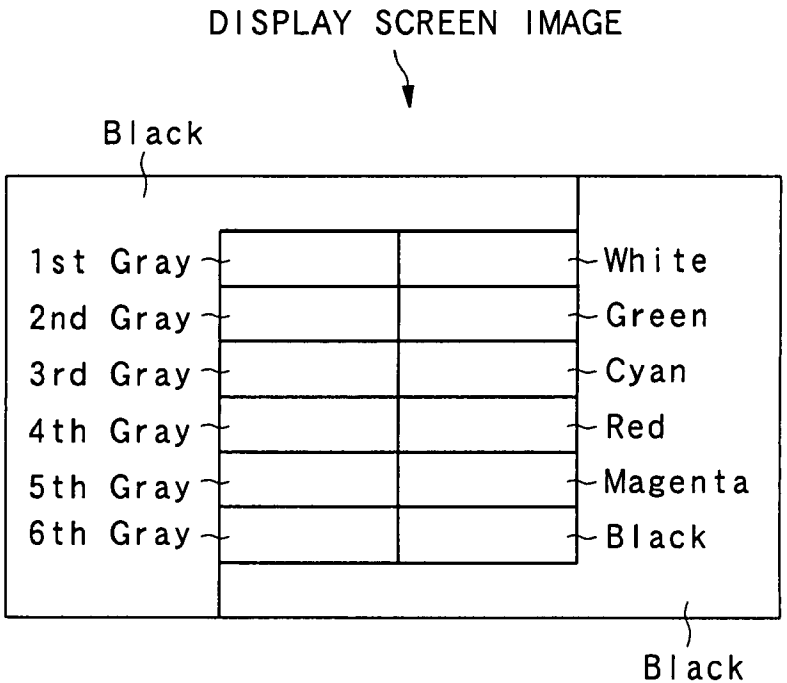
FIG. 4B shows an example of a PDP panel for displaying an image signal that is processed to be reversed against an inputted image signal to explain the reversal process in a brightness and color difference reversal process unit according to an embodiment of the present invention.
Figure 4A:
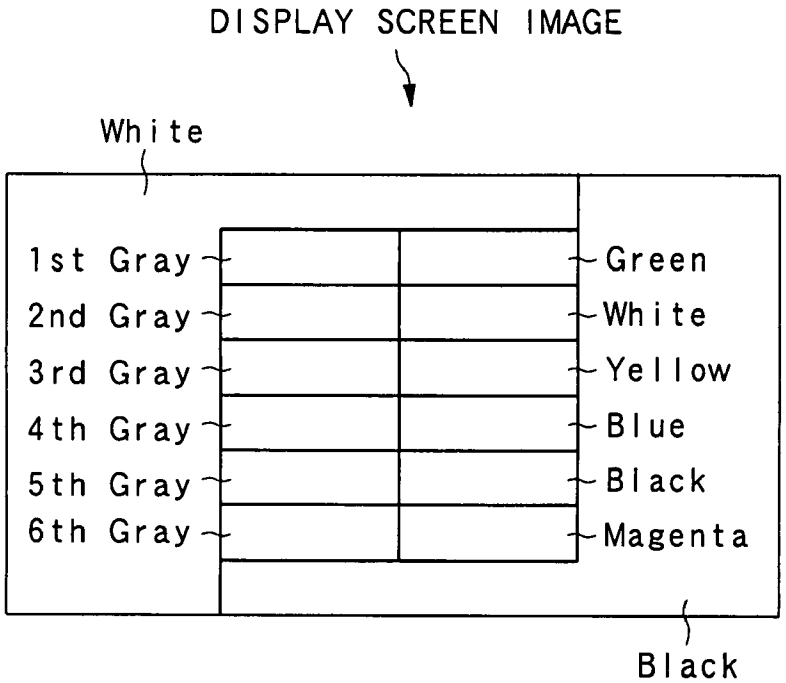
FIG. 4A shows an example of a PDP panel for displaying an image signal that is processed to be reversed against an inputted image signal to explain the reversal process in a brightness and color difference reversal process unit according to an embodiment of the present invention.

For example, when it is instructed to reverse a color difference signal related to R (hereinafter referred to as a R-Y signal) by the drive control unit 260 such that a color bar signal displaying a color bar image including white, black, and various colors as shown in FIG. 3A, the brightness and color difference reversal process unit 233 according to this embodiment generates a color bar signal for displaying an image as shown in FIG. 4A by reverse-processing a R-Y signal.

For example, when it is instructed to reverse a color difference signal related to B (hereinafter referred to as a B-Y signal) by the drive control unit 260 such that a color bar signal displaying a color bar image including white, black, and various colors as shown in FIG. 3A, the brightness and color difference reversal process unit 233 according to this embodiment generates a color bar signal for displaying an image as shown in FIG. 4B by reverse-processing a B-Y signal.

Meanwhile, since the color difference signal related to G (hereinafter referred to as a G-Y signal) is ordinarily generated from the R-Y signal and the G-Y signal, in this embodiment, the brightness and color difference reversal process unit 233 does not perform a reverse process of the G-Y signal. When it is instructed to reverse the G-Y signal by the drive control unit 260, an image signal for reversing the brightness of each cell CL of each pixel CL, which signal is supposed to display the image in the G-Y signal based on the R-Y signal and the B-Y signal, is generated.

For example, the brightness signal and the color signal are represented by the following equations:

$$Y=0.3R+0.59G+0.11B$$

$$R-Y=0.7R-0.59G-0.11B$$

$$B-Y=-0.3R-0.59G+0.89B \quad \text{(Equation 1)}$$

Meanwhile, the G-Y signal can be calculated from the R-Y signal and the B-Y signal according to Equation 1 as follows:

$$\begin{aligned} G-Y &= 0.51(R-Y)+0.19(B-Y) \quad \text{(Equation 2)} \\ &= 0.357R-0.3009G-0.0561B- \\ &\quad 0.057R-0.1121G+0.1169B \end{aligned}$$

Accordingly, in this embodiment, the brightness and color difference reversal process unit 233 calculates the G-Y signal by internally using the equation.

The digital image signals of the brightness signal and the color difference signals are inputted into the drive process unit 234.

Further, the drive process unit 234 conducts a multi tone wedge process such as various dither processes and a gamma process on the inputted digital signal, generates color signals related to RGB, and outputs the brightness signal to the subfield conversion unit 236 and the color signals related to RGB to the RGB signal reverse process unit 235.

The color signals related to RGB are inputted into the RGB signal reverse process unit 235. Then the RGB signal reverse process unit 235 conducts a reverse process on the inputted signals related to RGB under a control of the drive control unit and outputs thus obtained color signals to the RGB signal reverse process unit 235.

Specifically, the RGB signal reverse process unit 235 generates a display signal for reversing the brightness of each cell CL of each pixel PE displayed by the RGB signals or a display signal for reversing an emission and a stop of the-emission of each cell CL based on the inputted RGB signals when it is instructed to reverse each RGB signal.

Figure 5A:
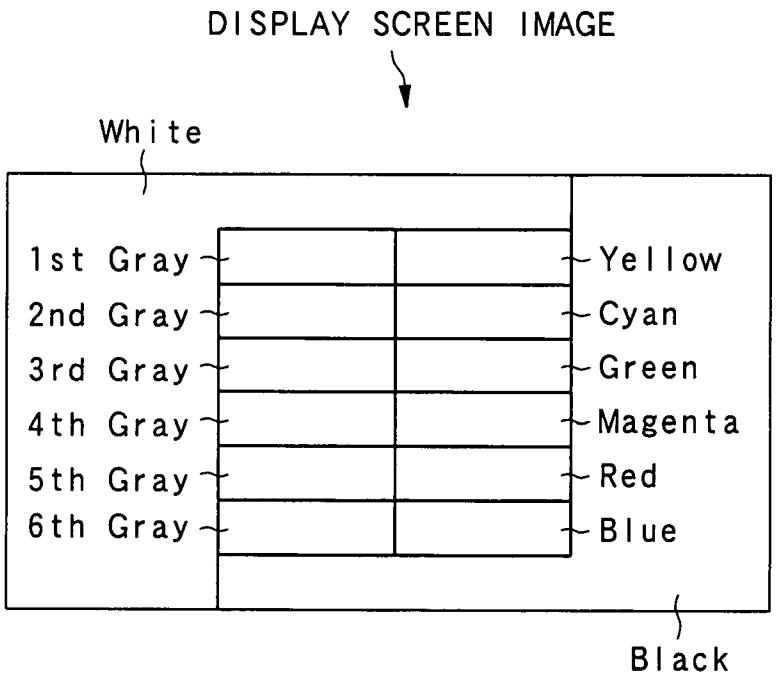
FIG. 5A shows an example of a PDP panel for displaying an image signal that is processed to be reversed against an inputted image signal to explain the reversal process in a brightness and color difference reversal process unit according to an embodiment of the present invention.
Figure 5B:
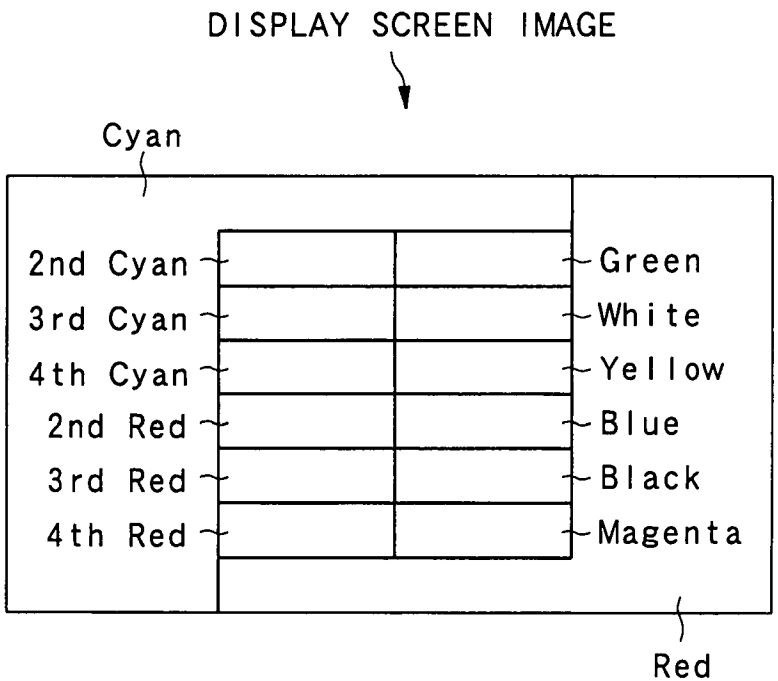
FIG. 5B shows an example of a PDP panel for displaying an image signal that is processed to be reversed against an inputted image signal to explain the reversal process in a brightness and color difference reversal process unit according to an embodiment of the present invention.

For example, when it is instructed to reverse the color signal of R of the inputted image signal (hereinafter referred to as an R signal) by the drive control unit 260 and a color bar signal displaying an image of the color bar including white, black, and various colors as shown in FIG. 5A is inputted, the RGB signal reverse process unit 235 according to the present embodiment generates a display signal for conducting a reverse of a R signal for each pixel PE, i.e. a gradation reverse for reversing a gradation of the R signal for each pixel PE or a color reverse for switching over between an emission and a stop of the-emission of a luminous cell CL corresponding to R of each pixel PE as shown in FIG. 5B.

Figure 6A:
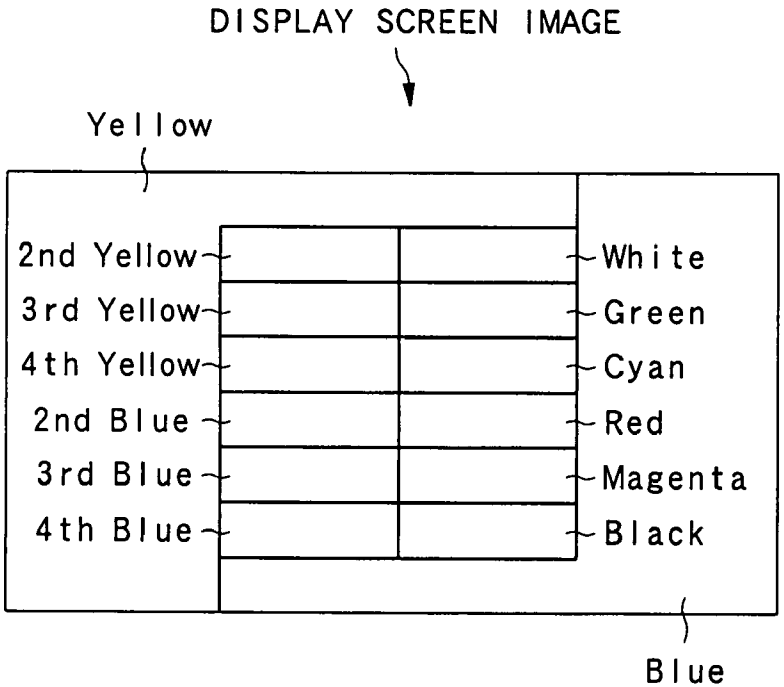
FIG. 6A shows an example of a PDP panel for displaying an image signal that is processed to be reversed against an inputted image signal to explain the reversal process in a brightness and color difference reversal process unit according to an embodiment of the present invention.

Further, for example, when it is instructed to reverse the color signal of B of the inputted image signal (hereinafter referred to as a B signal) by the drive control unit 260 and a color bar signal displaying an image of the color bar including white, black, and various colors as shown in FIG. 5A is inputted, the RGB signal reverse process unit 235 according to the present embodiment generates a display signal for conducting a reverse of a B signal for each pixel PE, i.e. a gradation reverse for reversing a gradation of the B signal for each pixel PE or a color reverse for switching over between an emission and a stop of the-emission of a luminous cell CL corresponding to B of each pixel PE as shown in FIG. 6A.

Figure 6B:
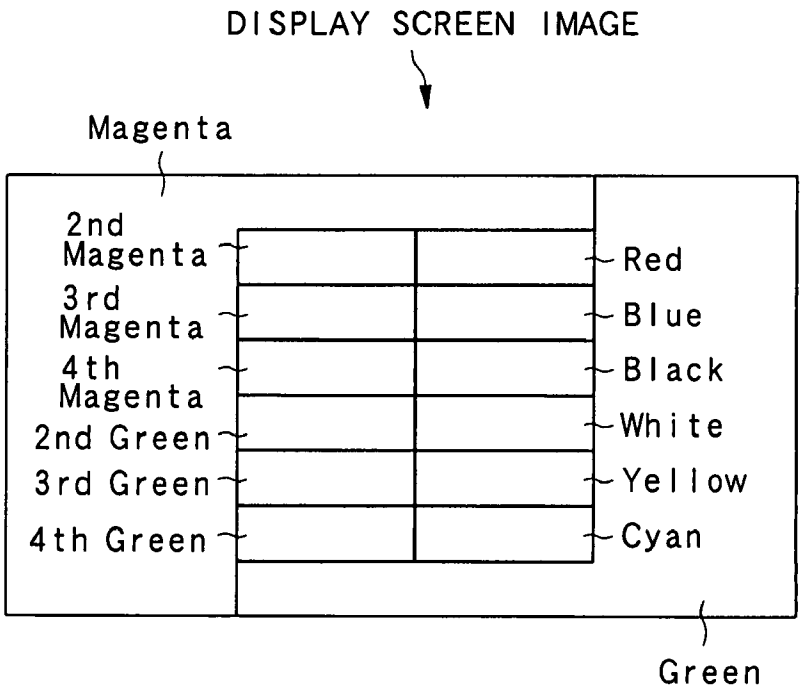
FIG. 6B shows an example of a PDP panel for displaying an image signal that is processed to be reversed against an inputted image signal to explain the reversal process in a brightness and color difference reversal process unit according to an embodiment of the present invention.

Further, for example, when it is instructed to reverse the color signal of Gof the inputted image signal (hereinafter referred to as a G signal) by the drive control unit 260 and a color bar signal displaying an image of the color bar including white, black, and various colors as shown in FIG. 5A is inputted, the RGB signal reverse process unit 235 according to the present embodiment generates a display signal for conducting a reverse of a G signal for each pixel PE, i.e. a gradation reverse for reversing a gradation of the G signal for each pixel PE or a color reverse for switching over between an emission and a stop of the-emission of a luminous cell CL corresponding to G of each pixel PE as shown in FIG. 6B.

The RGB signal reverse process unit 235 conducts a gradation reverse of each RGB signal based on gradients to be displayed by each signal. For example, when the display gradient of an R signal to be displayed is 70 in an 8-bit output depth, the RGB signal reverse process unit 235 generates an R signal having a gradient of 185(255-70=185).

Meanwhile, when the gradient is expressed by a gradation depth of 8-bit, 256 gradations of 0 to 255 are provided.

Further, as in FIGS. 3A and 3B, a 1st Gray to a 6th Gray represent gray colors sequentially darkened from the 1st Gray, a 2nd Red to a 4th Red and a 2nd Cyan to a 4 th Cyan represent a gray color including an element of Red or Cyan, and it is shown that the 2nd Red or the 2nd Cyan is brighter than the 3 rd Red or the 3 rd Cyan in FIGS. 5A and 5B.

Further, as in FIG. 5A, a 2nd Yellow to a 4th Yellow, a 2nd Blue to a 4th Blue, a 2nd Magenta to a 4th Magenta, and a 2nd Green to a 4th Green represent gray colors including each element, and it is shown that the 2nd Yellow is brighter than the 3 rd Yellow in FIGS. 6A and 6B.

The image signal obtained by conducting the reverse process on each of the RGB signals is inputted into the subfield conversion unit 236. The subfield conversion unit 236 generates a display signal by conducting a subfield conversion on the inputted signal and outputs the generated display signal to the PDP panel 100 through the frame memory 240.

Specifically, the subfield conversion unit 236 divides one display term of the cell CL in the inputted image signal into subfields as many as n. Display signals for realizing a gradation display are generated by conducting a series of drive steps for each subfield term, the steps including a reset term for initializing the cells CL, an address term for selectively setting a light emission state enabling lighting of the cell CL and a light stopping state stopping lighting of the cell CL, and a sustain term enabling continuous lighting of the cell CL which is set to be in the light emission state.

As described above, according to this embodiment, there are provided the A/D converter 210 for obtaining the image signal for displaying on the PDP panel 100, the differential/parallel conversion unit 220, the display signal generation unit 230 for driving the display panel based on the obtained image signal, and the display signal generation unit 230 generates the display signal conducting at least one of the reverse between the light emission state and the light stopping state for each cell CL and the reverse of the gradation in the light emission state of each cell CL, respectively for the pixels PE at the predetermined time.

According to this structure, the PDP 10 of this embodiment generates the display signal generates the display signal conducting at least one of the reverse between the light emission state and the light stopping state for each cell CL and the reverse of the gradation in the light emission state of each cell CL, respectively for the pixels PE at the predetermined time.

Therefore, since images with a specific image therein reversed at a predetermined time can be displayed on the PDP panel 100 in a case where only the specific image is displayed at various sites such as a certain public facility, it is possible to avoid deterioration of a constantly lighting cell CL of each pixel PE and baking of the PDP panel 100 caused by a persistence of vision occurring by the constant display of the specific image.

Further, the PDP 10 of this embodiment has a structure that the display signal generation unit 230 generates the display signal conducting the reverse of a light emission mode for each cell CL of RGB.

According to the structure, the PDP 10 of this embodiment can perform the reverse of the lighting mode respectively for each cell CL of RGB.

Further, the display drive control unit 260 has the structure of extracting the color difference signal out of the obtained image signal and generating the display signal of performing at least one of the reverse between the light emission state and the light stopping state and the reverse of the gradation in the light emission state of each cell 30.

According to the structure, the PDP 10 of this embodiment can perform the reverse of the lighting mode respectively for each cell CL of RGB based on the color difference signal.

The drive control unit 260 which detects at least one of the cumulative light emitting number and the cumulative light emitting time for each pixel PE and generates the display signal of performing the reverse of the lighting mode for each pixel PE in a drive device at the time of reaching the predetermined cumulative light emitting number or the predetermined cumulative light emitting time is further included in its structure According to this structure, the PDP 10 of this embodiment detects at least one of the cumulative light emitting number and the cumulative light emitting time for each pixel PE and performs the reverse of the lighting mode for each pixel PE in a drive device at the time of reaching the predetermined cumulative light emitting number or the predetermined cumulative light emitting time.

A cell CL ordinarily deteriorates in proportion to its cumulative light emitting number or its cumulative light emitting time, and a time of deterioration differs respectively depending on a color of cell. Therefore, by setting the cumulative light emitting number or the cumulative light emitting time respectively for the colors of the cells, it is possible to prevent a specific cell in each pixel from deteriorating.

Further, the operation unit 250 used when instructing the reverse of the lighting mode of each cell is further included. The display signal generation unit 230 generates the display signal for performing the reverse of the lighting mode for each pixel PE at the time instructed by the operation unit 250 to reverse.

According to this structure, the PDP 10 of this embodiment can perform the reverse of the lighting mode for each PE at a time instructed by the operation unit 250 to reverse. Therefore, the reverse process can be forcibly conducted when a persistence of vision is generated.

Meanwhile, although in this embodiment the PDP 10 of a discharge type is used as the display panel, the display panel is not limited to such PDP and may be a CRT or a liquid crystal display.

Further, the drive control unit 260 of this embodiment may instruct the RGB signal reverse process unit 235 to conduct the reverse process for each RGB signal or by combining RG, RB, or GB.

The present invention is not confined to the configurations listed in the foregoing embodiments, but it is easily understood that the person skilled in the art can modify such configurations into various other modes, within the scope of the present invention described in the claims.

The entire disclosures of Japanese Patent Applications No. 2004-57615 filed on Mar. 2, 2004 including the specification, claims, drawings and summary are incorporated herein by reference in its entirety.

What is claimed is:

1. A drive control apparatus for a display panel formed by arranging a plurality of pixels having a plurality of cells emitting lights of different colors comprising:

an obtaining device which obtains an image signal effecting a display on the display panel, and a drive device which generates a drive signal for driving the display panel based on the obtained image signal, a drive control device for detecting at least one of a cumulative light emitting number and a cumulative light emitting time with respect to each of the cells and also for judging whether or not the cumulative light emitting number or the cumulative light emitting time reaches a predetermined number or a predetermined time with respect to each of the cells, wherein the drive device generates the drive signal performing a reverse of a light emission mode which includes at least one of a reverse between a light emission state and a light stopping state for each of the cells and a reverse of gradation in the light emission state of each of the cells with respect to each of the cells when it is judged by the drive control device that the cumulative light emitting number reaches the predetermined number, the cumulative light emitting time reaches the predetermined time, or both the predetermined number and the predetermined time respectively reaches the predetermined number and the predetermined time.

2. The drive control apparatus for a display panel according to claim 1, wherein the drive device generates the drive signal performing a reverse of a light emission mode which includes at least one of a reverse between a light emission state and a light stopping state for each of the cells of the pixels and a reverse of gradation in the light emission state of each of the cells with respect to each of the colors.

3. The drive control apparatus for a display panel according to claim 2, wherein when each of the pixels is made up of cells respectively emitting lights of three primary colors of red (R), green (G), and blue (B), the drive device generates the drive signal performing a reverse of a light emission mode with respect to each of the three primary colors.

4. The drive control apparatus for a display panel according to claim 1, wherein when the drive device extracts a color difference signal from the obtained image signal and generates the drive signal from the extracted color difference signal, the drive device generates the drive signal performing a reverse of a light emission mode which includes at least one of a reverse between a light emission state and a light stopping state for each of the cells of the pixels and a reverse of gradation in the light emission state of each of the cells with respect to each of the color difference signals.

5. The drive control apparatus for a display panel according to claim 1, further comprising:

an operation device used at a time of instructing the reverse of a light emission mode of each of the cells, wherein the drive device generates the drive signal for performing the reverse of the lighting mode for each of the pixels at the time when the operation device instructs the reverse.

6. The drive control apparatus for a display panel according to claim 2, further comprising:

an operation device used at a time of instructing the reverse of a light emission mode of each of the cells, wherein the drive device generates the drive signal for performing the reverse of the lighting mode for each of the pixels at the time when the operation device instructs the reverse.

7. The drive control apparatus for a display panel according to claim 3, further comprising:

an operation device used at a time of instructing the reverse of a light emission mode of each of the cells, wherein the drive device generates the drive signal for performing the reverse of the lighting mode for each of the pixels at the time when the operation device instructs the reverse.

8. The drive control apparatus for a display panel according to claim 4, further comprising:

an operation device used at a time of instructing the reverse of a light emission mode of each of the cells, wherein the drive device generates the drive signal for performing the reverse of the lighting mode for each of the pixels at the time when the operation device instructs the reverse.

9. A drive control apparatus for a display panel formed by arranging a plurality of pixels emitting lights of different colors comprising:

an obtaining device which obtains an image signal effecting a display on the display panel; and a drive device which generates a drive signal for driving the display panel based on the obtained image signal;

a drive control device for detecting at least one of a cumulative light emitting number and a cumulative light emitting time with respect to each of the pixels and also for judging whether or not the cumulative light emitting number or the cumulative light emitting time reaches a predetermined number or a predetermined time with respect to each of the pixels, wherein the drive device generates the drive signal performing a reverse of a light emission mode which includes at least one of a reverse between a light emission state and a light stopping state for each of the pixels and a reverse of gradation in the light emission state of each of the pixels with respect to each of the pixels when it is judged by the drive control device that the cumulative light emitting number reaches the predetermined number, the cumulative light emitting time reaches the predetermined time, or both the predetermined number and the predetermined time respectively reaches the predetermined number and the predetermined time.

10. The drive control apparatus for a display panel according to claim 1, wherein the drive device generates the drive signal performing a reverse of a light emission mode which includes at least one of a reverse between a light emission state and a light stopping state for each of the pixels and a reverse of gradation in the light emission state of each of the pixels with respect to each of the colors.

11. The drive control apparatus for a display panel according to claim 2, wherein when each of the pixels respectively emits lights of three primary colors of red (R), green (G), and blue (B), the drive device generates the drive signal performing a reverse of a light emission mode with respect to each of the three primary colors.

12. The drive control apparatus for a display panel according to claim 1, wherein when the drive device extracts a color difference signal from the obtained image signal and generates the drive signal from the extracted color difference signal, the drive device generates the drive signal performing a reverse of a light emission mode which includes at least one of a reverse between a light emission state and a light stopping state for each of the pixels and a reverse of gradation in the light emission state of each of the pixels with respect to each of the color difference signals.

* * * * *